US007950336B2

(12) United States Patent
Phillips

(10) Patent No.: US 7,950,336 B2
(45) Date of Patent: May 31, 2011

(54) TABLE ASSEMBLY, JOINTED TABLE, AND METHOD OF CREATING A CLEAN INTERSTICE

(75) Inventor: Wayne Phillips, Paramus, NJ (US)

(73) Assignee: Aero Manufacturing Company, Inc., Clifton, NJ (US)

( * ) Notice: Subject to any disclaimer, the term of this patent is extended or adjusted under 35 U.S.C. 154(b) by 294 days.

(21) Appl. No.: 12/182,662

(22) Filed: Jul. 30, 2008

(65) Prior Publication Data

US 2010/0024690 A1 Feb. 4, 2010

(51) Int. Cl.
*A47B 57/00* (2006.01)

(52) U.S. Cl. ..... 108/64; 52/468; 52/591.5; 108/65; 108/69

(58) Field of Classification Search ..... 108/64, 108/65, 66, 69, 54.1; 52/461, 470, 468, 590.2, 52/591.5; 403/300, 321, 13, 14, 49, 331
See application file for complete search history.

(56) References Cited

U.S. PATENT DOCUMENTS

| | | | | | |
|---|---|---|---|---|---|
| 2,694,609 | A | * | 11/1954 | Trafford | 108/64 |
| 2,723,171 | A | * | 11/1955 | Carder | 108/64 |
| 2,836,475 | A | * | 5/1958 | Sapp | 108/64 |
| 2,905,334 | A | | 9/1959 | Gottschalk et al. | |
| 3,001,844 | A | * | 9/1961 | Spring | 108/64 |
| 3,820,477 | A | * | 6/1974 | griffin | 108/64 |
| 3,915,100 | A | * | 10/1975 | Sullivan | 108/64 |
| 4,150,630 | A | * | 4/1979 | Pokorny et al. | 108/64 |
| 4,815,393 | A | * | 3/1989 | Pollak | 108/69 |
| 5,018,628 | A | | 5/1991 | Schenck et al. | |
| 5,560,302 | A | * | 10/1996 | Diffrient et al. | 108/64 |
| 5,595,427 | A | | 1/1997 | Peters et al. | |
| 5,678,948 | A | * | 10/1997 | White | 108/64 |
| 5,947,628 | A | * | 9/1999 | Hansen | 108/64 |
| 2006/0102056 | A1 | * | 5/2006 | Wolfe | 108/65 |

FOREIGN PATENT DOCUMENTS

GB 2142528 A * 1/1985

* cited by examiner

*Primary Examiner* — José V Chen
(74) *Attorney, Agent, or Firm* — Vedder Price P.C.

(57) ABSTRACT

This disclosure relates to a table assembly, a jointed table, and a method of creating a clean interstice between adjacent tables. More particularly, this disclosure relates to the use of both male and female support connectors where the male connector includes a junction plate and the female connector includes a spacer and a holder plate to create a female connector space. In another embodiment, silicone joints and industrial grade stainless steel plate are used. A method of creating a clean joint by depositing silicone in an interstice between adjacent tables is also disclosed.

17 Claims, 4 Drawing Sheets

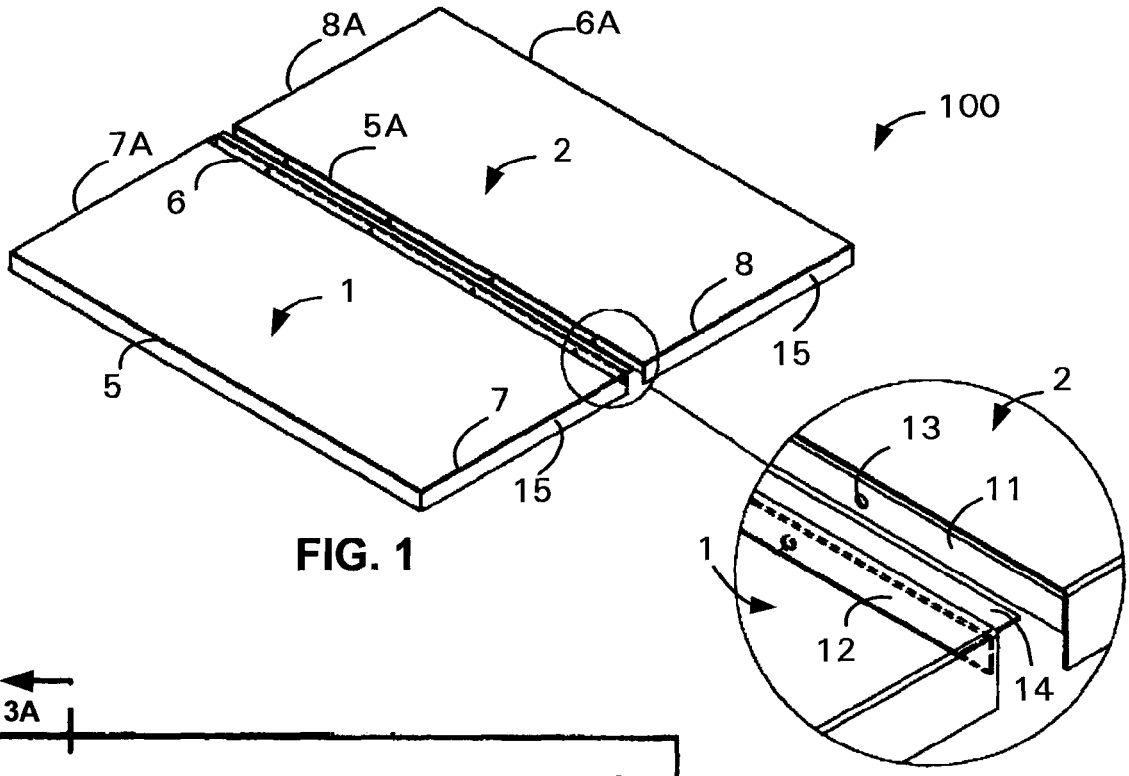
FIG. 1
FIG. 2
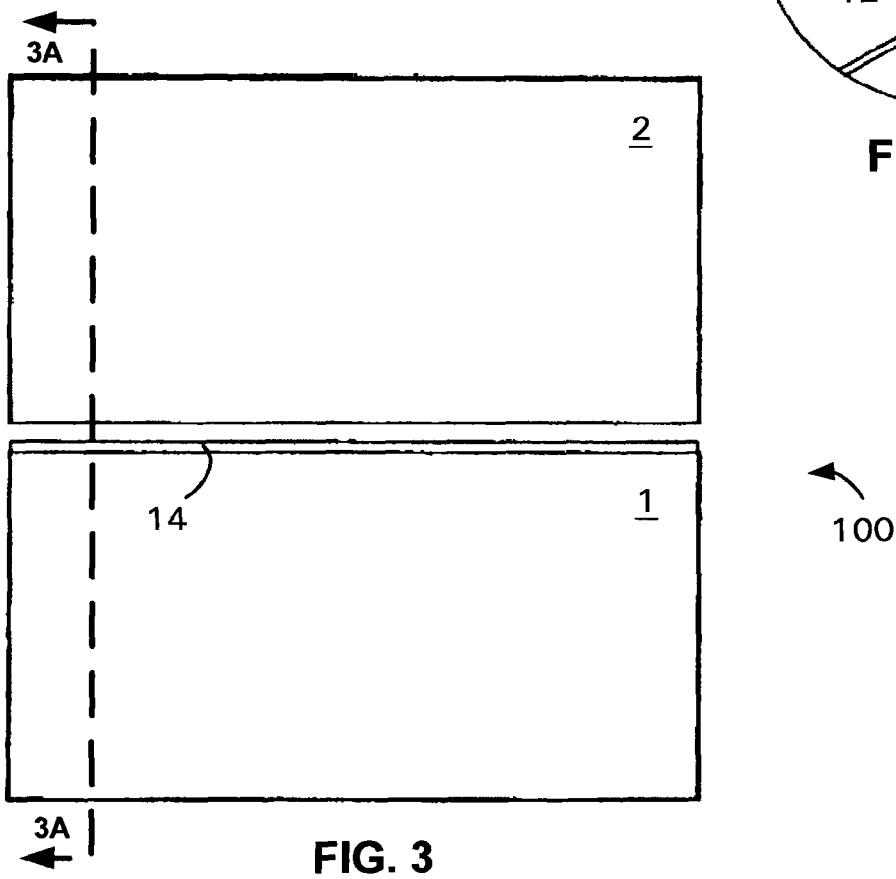
FIG. 3

TABLE ASSEMBLY, JOINTED TABLE, AND METHOD OF CREATING A CLEAN INTERSTICE

FIELD OF THE DISCLOSURE

This disclosure relates to a table assembly, a jointed table, and a method of creating a clean interstice between tables. More particularly, this disclosure relates to the use of a metal strip for connecting separate stainless steel tables.

BACKGROUND

In particular work environments, such as industrial kitchens and laboratories, differently sized work surfaces are necessary to accommodate different tasks. For instance, a chef who is preparing a small dish intended for one customer does not require the same amount of work surface area as a chef preparing a large dish intended for many customers. However, constraints on physical space make it impractical for such a work environment to keep a variety of differently sized work surfaces on site.

It is also important that particular work environments maintain a certain level of cleanliness. For instance, industrial kitchens must comply with health regulations to ensure the quality of food prepared therein. Similarly, laboratories must maintain a clean environment to ensure the reliability of the laboratory's research. Therefore, it is imperative that work surfaces in such environments do not harbor undesirable substances lodged in crevasses and interstices.

Existing devices used to join work surfaces are complicated, time-consuming, and expensive. In addition, such devices are prone to collecting undesirable substances in the joints connecting the work surfaces. One type of prior art device connects adjacent work surfaces using channels having upper and lower flanges. The upper flange of a first channel is fixed to the underside of a first work surface. The lower flange of the first channel is fixed to the top surface of a cabinet base. Similarly, the upper flange of a second channel is fixed to the underside of a second work surface and the lower flange of the second channel is fixed to the top surface of the cabinet base. When the first and second work surfaces are brought in close proximity, a flat, rigid strip is inserted between the upper flanges of the channels to hold the tops of the work surfaces in a coplanar relationship. Bolts are then used to connect the adjacent channels. As the bolts are tightened, the work surfaces are pulled together.

Such a system is overly complex, costly, and insufficient for creating a clean joint between the work surfaces. Connecting work surfaces using channels requires an excessive number of interacting parts, such as the channels themselves, flanges on the channels, a flat strip, and bolts. The cost of connecting the work surfaces is likely proportional to the number of individual parts that are necessary to accomplish such connections.

Another type of prior art device connects adjacent work surfaces using mating edge members. A first work surface has a female edge member along one side and a second work surface has a male edge member along a juxtaposed side. The female edge member has two outwardly disposed ribs and three inwardly disposed channels. The male edge member has three outwardly disposed ribs and two inwardly disposed channels. When the side of the first work surface is brought together with the side of the second work surface, the ribs of the male edge member extend into the channels of the female edge member, and the ribs of the female edge member extend into the channels of the male edge member. The mated edge members form a joint connecting the two work surfaces.

Connecting work surfaces through the use of mating edge members is overly complex and expensive. One reason is that the edge members must be manufactured precisely to ensure proper mating. Even a slight defect in the manufacture of the edge members can result in there being a seam between the work surfaces, wherein undesirable substances can be deposited. There is likely a significant cost associated with manufacturing edge members that mate sufficiently well to keep undesirable substances out of the seams between the work surfaces. Further, the system at issue does not place any adhesive or similar joining substance in the seam between the mating edge members. Accordingly, even precisely manufactured mating edge members leave a slight interstice between the work surfaces, wherein undesirable substances can be deposited.

Yet another type of prior art device joins two work surfaces using wooden strips operating with tension springs. One wooden strip is adhesively mounted to the underside of a first work surface while another wooden strip is mounted to the underside of a second work surface. A side of the first work surface is then positioned in adjacent a side of the second work surface, and adhesive is applied between the two edges. Tension springs are then extended from the wooden strip on the first work surface to the wooden strip on the second work surface, pulling the two work surfaces together as the adhesive between the edges sets.

Such a system is overly complex and expensive because it utilizes an excessive number of interacting parts to connect the work surfaces. The system is also very time-consuming to use because it requires a user to wait for adhesive to set on two separate occasions before the work surfaces can be connected. Should the work surfaces become disconnected, it is also very time consuming to reconnect them because the aforementioned steps would have to be repeated in full. Also, adhesive connections do not typically provide the strength and stability of mechanical connections.

It is therefore advantageous to have a simple, quick, and inexpensive device for joining individual work surfaces to produce one large work surface. It is also advantageous if the joined work surfaces could be easily disjoined. Finally, it is beneficial if the seam between the joined work surfaces is resistant to the collection of undesirable substances.

SUMMARY

This disclosure relates to a table assembly, a jointed table, and methods of creating a clean interstice between adjacent tables. More particularly, this disclosure relates to the use of both male and female support connectors where the male connector includes a junction plate and the female connector includes a spacer and a holder plate to create a female connector space. In another embodiment, the table assembly uses silicone joints and industrial grade stainless steel. A method of creating a clean joint by depositing silicone in an interstice between adjacent tables is also disclosed.

BRIEF DESCRIPTION OF THE DRAWINGS

Certain preferred embodiments are shown in the drawings. However, it is understood that the present disclosure is not limited to the arrangements and instrumentality shown in the attached drawings.

FIG. 1 a isometric view of a table assembly with an L-shaped plate holder and an L-shaped support plate shown disassembled and having a small interstice between each adjacent table according to an embodiment of the present disclosure.

FIG. 2 is a close-up view of the interstice area of FIG. 1 showing with greater detail and some transparency the L-shaped plate holder and the L-shaped support plate as placed on the table assembly according to an embodiment of the present disclosure.

FIG. 3 is a top view of the table assembly of FIG. 1 according to an embodiment of the present disclosure.

DETAILED DESCRIPTION

Figure 3A:
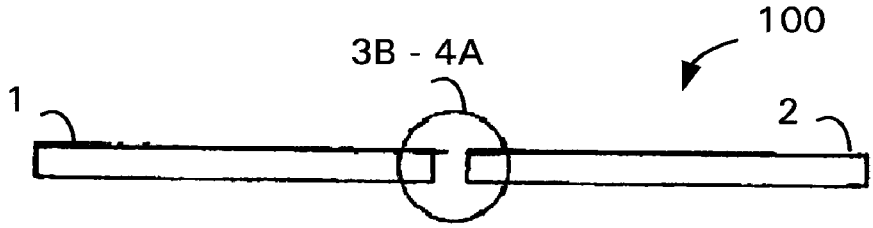
FIG. 3A is a cut view along 3A-3A as shown in FIG. 3 of the table assembly of FIG. 1 according to an embodiment of the present disclosure.

For the purposes of promoting and understanding the invention and principles disclosed herein, reference is now made to the preferred embodiments illustrated in the drawings, and specific language is used to describe the same. It is nevertheless understood that no limitation of the scope of the invention is thereby intended. Such alterations and further modifications in the illustrated devices and such further applications of the principles disclosed as illustrated herein are contemplated as would normally occur to one skilled in the art to which this disclosure relates.

FIG. 1 a isometric view of a table assembly 100 with a L-shaped plate holder 11 and a L-shaped support plate 12 shown disassembled with a small interstice between each adjacent table 1, 2 according to an embodiment of the present disclosure. The table assembly 100 as shown does not include legs or other structural elements that can be placed below or above the adjacent tables 1, 2 to hold or support the flat surfaces. One of ordinary skill in the art recognizes how the tables 1, 2 can be supported, fixed, attached, or held as part of a table assembly 100.

In one embodiment, a flat piece of metal, such as a junction plate 14, also known as a slip joint 14, is used as part of the joint mechanism for holding adjacent flat surfaces such as tables 1, 2 together. While this disclosure applies with equal force to any and all types of surfaces, tables and table assembly 100 for the food industry, lab industry, or any other industry with stringent cleaning requirements can be made of material with polished surfaces such as glass, marble, plastic, or metal. In one preferred embodiment, the table assembly 100 is made of a metal sheet or a stainless steel metal sheet.

In one embodiment, a table assembly 100 includes a first table 1 and a second table 2, each table having a top surface 20, 21, respectively, as shown with greater detail in FIGS. 3B, 3C, 4A, and 4B, and a bottom surface 50, 51 on the same figures. The top surfaces 20, 21 are in opposition to the respective bottom surfaces 50, 51. For simplicity, flat surfaces and tables of rectangular geometry are shown. Each table 1, 2 in the rectangular configuration includes a front end 6, 6A, a back end 5, 5A across from the front end 6, 6A, and a first 7, 8 and second side edge 7A, 8A, each extending from the front end 6, 6A to the back end 5, 5A of each respective table 1, 2. While edges and ends are described in relation to a rectangular table assembly 100, the use of any geometry having edges capable of association is contemplated. As a nonlimiting example, two edges can be complimentary shapes with possible tessellation.

Figure 3B:
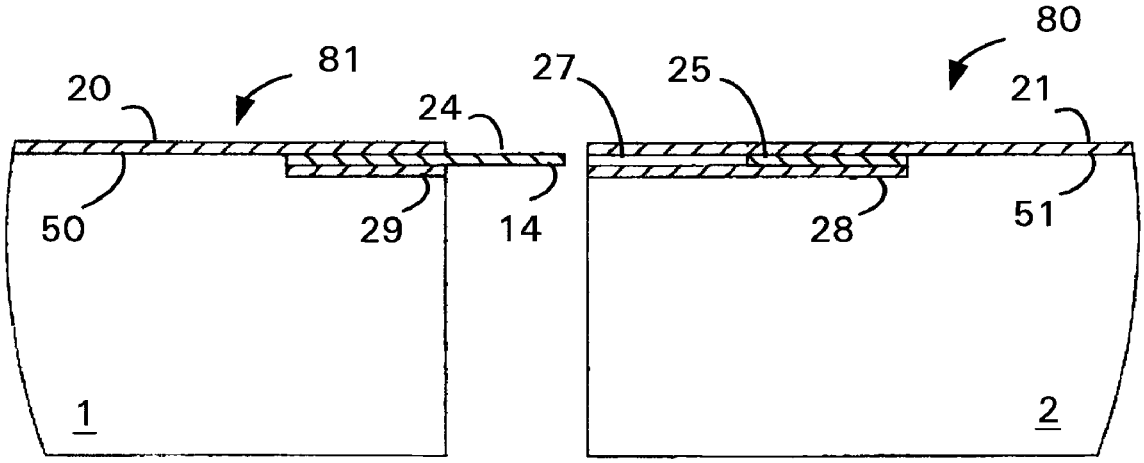
FIG. 3B is a detail view as illustrated by the circle 3B-4A of the table assembly in a disassembled position where the plate holder and the support plates are flat according to another embodiment of the present disclosure.
Figure 3C:
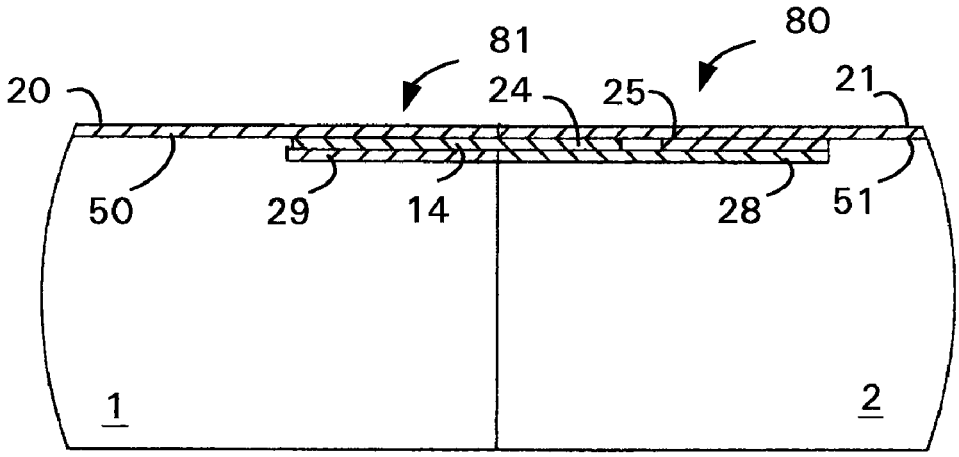
FIG. 3C is an assembled view of the detail view of FIG. 3B.
Figure 4A:
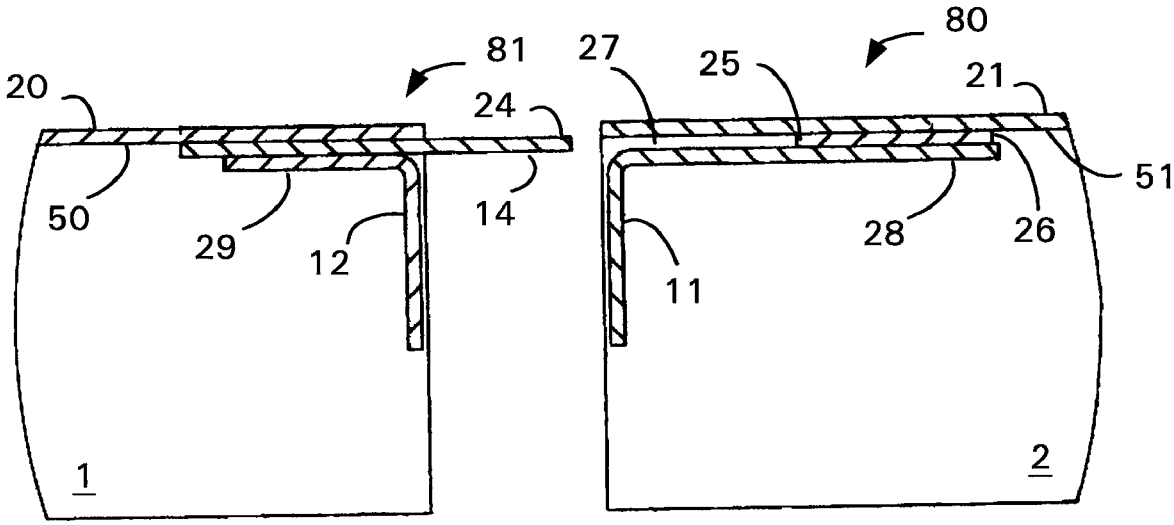
FIG. 4A is a detail view as illustrated by the circle 3B-4A of the table assembly shown in FIG. 3A in a disassembled position where the plate holder and the support plates are L-shaped according to another embodiment of the present disclosure.
Figure 4B:
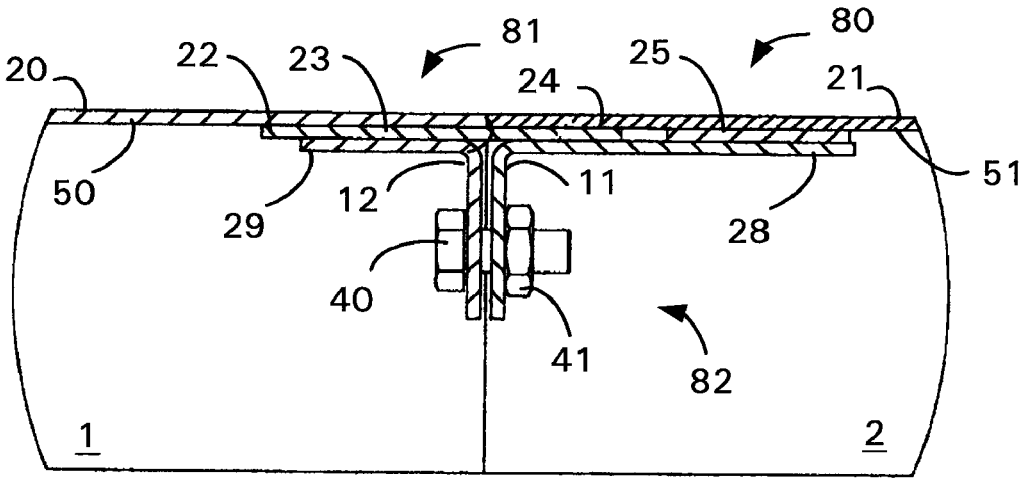
FIG. 4B is an assembled view of the detail view of FIG. 3A.

FIG. 3 shows a top view of the table assembly 100 of FIG. 1. FIG. 3A is a plan view of FIG. 3 as seen along cut line 3A-3A. FIGS. 3B, 3C, and 4A, 4B are portions as seen from the circle shown in FIG. 3A with close-up views of the slip joint mechanism. Two possible embodiments are shown consecutively. The first possible embodiments is shown in FIGS. 3B and 3C and includes a flat holder plate 28 and a flat support plate 29. In a second embodiment shown as FIGS. 1, 2, 4A, and 4B, the holder plate 28 is L-shaped, and the support plate 29 is also L-shaped. In the embodiment as shown in FIGS. 4A and 4B, the L-shaped holder plate is one inch high by two inch long and is connected at the end portion of the long segment to a one inch long spacer plate 25. The support plate is a metal angle one inch by one inch in dimension. While one embodiment is described, it is understood that the above-described disclosure applies to any type of support structure having the different elements and limitations described herein.

The second table 2 includes a female support 80 with a spacer plate 25 connected to the bottom surface 51 of the second table 2, and a holder plate 28 where at least a portion of the holder plate 28 is connected to the spacer plate 25 for defining a female connector space 27. The spacer plate 25 as shown is a continuous strip of metal of a thickness equal or slightly superior to the junction plate 14 to create a female connector space 27 capable of accommodating the junction plate 14.

The first table 1 comprises a male support 81 with a junction plate 14 where at least a first portion of the junction plate 23 is connected to the bottom surface 50 of the first table 1, and a second portion 24 of the junction plate is slidably inserted into the female connector space 27, and wherein the front end 6 of the first table 1 is adjacent to the back end 5A of the second table 2 as shown generally in FIG. 1.

In one alternate embodiment, the table assembly 100 includes a silicone joint (not shown) placed at the interstice between the front end 6 of the first table 1 and the back end 5A of the second table 2. In one embodiment, the edges of the front end 6 and the back end 5A are cut raw edges of unfinished material. The interstice is also filled with bead of NSF-approved silicone. Silicone can be applied in a plurality of ways, including but not limiting to the use of a spatula.

In one mode of assembly of the male support 81, and the female support 80 below the surface of the table assembly 100, the spacer plate 25 is spot welded to the bottom surface 51 of the second table 2 and the holder plate 28 is in turn spot welded to the spacer plate 25. In the embodiment shown, spot welding is contemplated to fix the spacer plate 25 and the holder plate 28 to the table 2. Spot welding secures the plates without leaving thermal marks or deforming the table 2. Other fixation means, such as a bottom surface 51 with tabs, slits, openings, and plates 25, 28 that can be fixed using, by way of example only, magnetized surfaces, adhesive, glue, etc., are also contemplated.

In one embodiment as shown, the first portion 23 of the junction plate 14 is larger than the second portion 24. In the preferred embodiment, the first portion is one inch wide and the second portion is three quarter inch wide. For the male support 81, what is also contemplated is the use of spot welding to secure the different elements within the male support 81 to the bottom surface of the first table 1. In an alternate embodiment (as shown), the male support 81 further comprises a support plate 29 also spot welded to the junction plate 14. The table assembly further comprising a connector securing a portion of the L-shaped support plate and L-shaped holder plate.

In another embodiment, a jointed table 100 is made with a first panel 1 and a second panel 2, each panel having a top surface 20, 21 and a bottom surface 50, 51 in respective opposition, a front end 6, 6A, a back end 5, 5A across from the respective front end 6, 6A, a first 7, 7A, a second side edge 8, 8A each extending from the respective front end 6, 6A to the respective back end 5, 5A, and a sidewall 15 extending downwardly from the side edges 7, 7A, 8, and 8A. FIG. 1 shows a jointed table 100 with a side wall at the back end 5 of the first panel 1, and the front end 6A of the second panel 2. While a table 100 with a small ledge is shown, what is contemplated is any lateral structure of any length and geometry.

FIG. 2 shows 5/16 inch holes aligned for the passage of bolts 40 and nuts 41 as shown in FIG. 4B. While one type of connector is shown to secure the first panel/table 1 to the second panel/table 2 at the junction, any type of connector 82 or means to secure the tables/panels 1, 2 together is contemplated.

Figure 5:
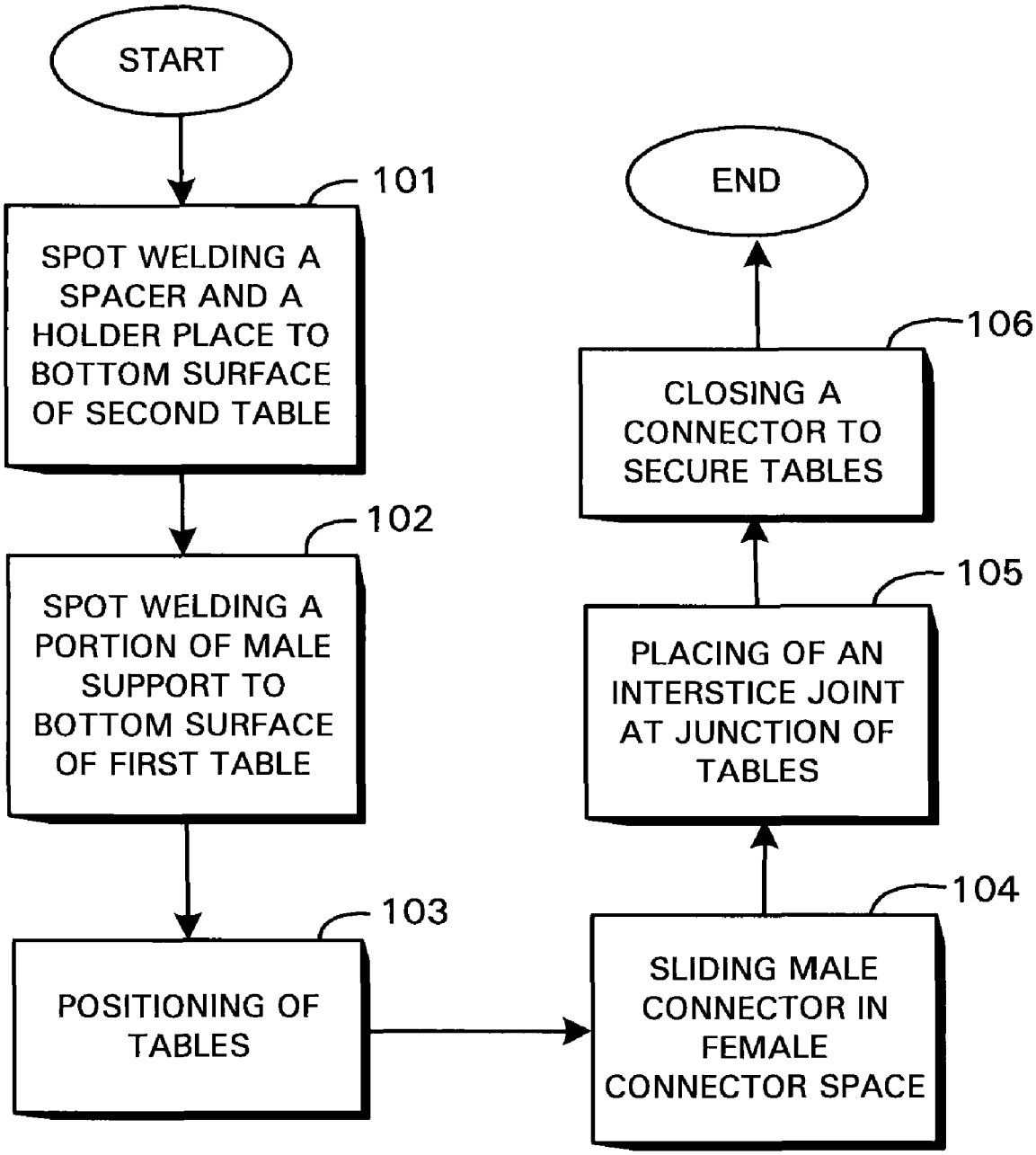
FIG. 5 is a diagram representation of the method for creating a clean interstice between a first and a second table, each with a top surface.

In another embodiment as shown in FIG. 5, a method of creating a clean interstice between first and second tables 1, 2, each with a top surface 20, 21 and a bottom surface 50, 51 in opposition, a front end 6, 6A, and a back end 5, 5A across from the front end 6, 6A is shown. The method comprises the steps of spot welding 101 a spacer 25 and a holder plate 28 to the bottom surface 51 of the second table 2 to create a female connector space 27 between the holder plate 28 and the bottom surface 51 of the second table. In subsequent steps, the method includes spot welding 102 at least a first portion 23 of the junction plate 14 in a male support 81 to the bottom surface of the first table 50, then positioning 103 the first table 1 in close proximity to the second table 2 and slidably inserting 104 a second portion 24 of the male support 81 in the female connector space 27 until the front end 6 of the first table 1 is in contact with the back end 5A of the second table 2.

The method can further include a subsequent step of placing 105 an interstice joint (not shown) made of silicone or any other joint material between the front end 6 of the first able 1 and the back end 5A of the second table 2. In yet another embodiment, each table can include a connector 82, and the method can include the step of closing 106 the connector 82 to secure the first table 1 to the second table 2.

Persons of ordinary skill in the art appreciate that although the teachings of this disclosure have been illustrated in connection with certain embodiments and methods, there is no intent to limit the invention to such embodiments and methods. On the contrary, the intention of this disclosure is to cover all modifications and embodiments falling fairly within the scope the teachings of the disclosure.

What is claimed is:

1. A stainless steel table assembly comprising:

a first stainless steel table and a second stainless steel table, each table having a top surface and a bottom surface in opposition thereto, a front end and a back end across from the front end, and a first and second side edge, each side edge extending from the front end to the back end of each respective table and a sidewall extending downwardly from the side edges;

wherein the second table comprises a stainless steel female support made of a spacer plate spot welded to the bottom surface at the back end of the second table, and a holder plate where at least a portion of the holder plate is spot welded to the spacer plate for defining a female connector space formed in an open area between the holder plate, the spacer plate, and the bottom surface of the second table at the back end, wherein the first table comprises a stainless steel male support at the front end made of a junction plate over the width of the front end where at least a first portion of the junction plate is spot welded to the bottom surface of the first table at the front end, and a second portion of the junction plate extruding from the front end is slidably inserted into the female connector space at the back end, and wherein the front end of the first table is adjacent to the back end of the second table creating an interstice between the front end and the back end.

2. The table assembly of claim 1, further comprising a silicone joint placed at the interstice.

3. The table assembly of claim 1, wherein the first portion is larger than the second portion, and wherein female connector space is larger than the width of the second portion.

4. The table assembly of claim 1, wherein the male support further comprises a support plate spot welded to the junction plate.

5. The table assembly of claim 4, wherein the support plate and the holder plate are flat.

6. The table assembly of claim 4, wherein the support plate and the holder plate are L-shaped.

7. The table assembly of claim 6, further comprising a connector securing a portion of the L-shaped support plate to a portion of the L-shaped holder plate.

8. A jointed table comprising:

a first panel and a second panel, each panel having a top surface and a bottom surface in opposition thereto, a front end and a back end across from the front end, a first and second side edge, each side edge extending from the front end to the back end, and a sidewall extending downwardly from the side edges;

wherein the second panel comprises a female support made of a spacer plate spot welded to the bottom surface at the back end of the second panel, and a holder plate where at least a portion of the holder plate is spot welded to the spacer plate for defining a female connector space formed in an open area between the holder plate, the spacer plate, and the bottom surface of the second table at the back end, wherein the first panel comprises a male support at the front end made of a junction plate over the width of the front end where at least a first portion of the junction plate is spot welded to the bottom surface of the first panel at the front end, and a second portion of the junction plate extruding from the front end is slidably inserted into the female connector space at the back end, and wherein the front end of the first panel is adjacent to the back end of the second panel creating an interstice between the front end and the back end.

9. The jointed table of claim 8, further comprising a silicone joint placed at the interstice.

10. The jointed table of claim 8, wherein the second portion is larger than the first portion, and wherein female connector space is larger than the width of the second portion.

11. The jointed table of claim 8, wherein the male support further comprises a support plate spot welded to the junction plate.

12. The jointed table of claim 11, wherein the support plate and the holder plate are flat.

13. The jointed table of claim 11, wherein the support plate and the holder plate are L-shaped.

14. The jointed table of claim 13, further comprising a connector securing a portion of the L-shaped support plate to a portion of the L-shaped holder plate.

15. A method of creating a clean interstice between a first stainless steel table and a second stainless steel table, each table having a top surface and a bottom surface in opposition thereto, a front end and a back end across from the front end, the method comprising the steps of:

spot welding a stainless steel spacer and a stainless steel holder plate to the bottom surface of the second table for creating a female connector space formed in an open area between the holder plate, the spacer plate, and the bottom surface of the second table;

spot welding at least a first portion of a male support to the bottom surface of the first table;

positioning the first table in close proximity to the second table; and slidably inserting a second portion of the male support in the female connector space until the front end of the first table is in contact with the back end of the second table.

16. The method of claim 15, further comprising the step of placing an interstice joint made of silicone between the front end of the first able and the back end of the second table.

17. The method of claim 16, wherein each table further comprises a connector and the method comprises the further step of closing a connector to secure the first table to the second table.

* * * * *